US005648747A

United States Patent [19]

Grothe et al.

[11] Patent Number: 5,648,747

[45] Date of Patent: Jul. 15, 1997

[54] PLANAR FILTER HAVING AN OVERCOUPLING STRIPLINE AN INTEGRAL MULTIPLE OF A HALF WAVELENGTH IN LENGTH

[76] Inventors: Wolfgang Grothe, Talstrasse 15, 75233 Tiefenbronn; Matthias Klauda, Geisbergstrasse 3, 91056 Erlangen; Stefan Mueller, Laerholzstrasse 17/19, 44801 Bochum; Claus Schmidt, Alte Stuttgarter Strasse 78, 71106 Magstadt, all of Germany

[21] Appl. No.: 595,908

[22] Filed: Feb. 6, 1996

[30] Foreign Application Priority Data

Mar. 15, 1995 [DE] Germany ..... 195 09 251.1

[51] Int. Cl.[6] ..... H01P 1/203

[52] U.S. Cl. ..... 333/204; 333/219

[58] Field of Search ..... 333/202, 204, 333/219, 246

[56] References Cited

U.S. PATENT DOCUMENTS 4,418,324 11/1983 Higgins ..... 333/204

5,373,271 12/1994 Hirai et al. ..... 333/204 X

FOREIGN PATENT DOCUMENTS 0487396 5/1992 European Pat. Off. ..... 333/204

0627781 12/1994 European Pat. Off. ..... 333/204

6120705 4/1994 Japan ..... 333/204

OTHER PUBLICATIONS

IRE transmission on Microwave Theory and Techniques, Apr. 1958, pp. 223–231, S.B. Cohn, "Parallel–Coupled Transmission–Line–Resonator Filters".

IEEE Transactions on Microwave theory and Techniques, vol. MTT–24, No. 4, Apr. 1976, pp. 172–181, Ralph Levy, "Filters with Single . . . ".

*Primary Examiner*—Benny Lee

*Assistant Examiner*—Barbara Summons

*Attorney, Agent, or Firm*—Michael J. Striker

[57] ABSTRACT

A planar filter is proposed in which a plurality of striplines arranged next to one another on a substrate are supplemented by an overcoupling stripline which couples to one another two striplines which are not immediately neighboring. The length of the overcoupling stripline is an integral multiple of a half wavelength of the center frequency of the filter.

7 Claims, 1 Drawing Sheet

PLANAR FILTER HAVING AN OVERCOUPLING STRIPLINE AN INTEGRAL MULTIPLE OF A HALF WAVELENGTH IN LENGTH

BACKGROUND OF THE INVENTION,

The invention proceeds from a planar filter The article entitled "Parallel-Coupled Transmission-Line-Resonator Filters" in the IRE Trans. on Microwave Theory and Techniques, 1958, pages 223 ff. by S. B. Cohn discloses a microstripline filter in which a plurality of striplines are arranged next to one another. In this case, the striplines overlap one another on a portion of their length and are thereby coupled to their respective neighbor. In addition, the article entitled "Filters with Single Transmission Zeros at Real or Imaginary Frequencies" in IEEE Transactions on Microwave Theory and Techniques, Vol. MTT-24, No. 4, April 1976, pages 172–181 discloses waveguide filters in which pole points are generated in the damping by overcoupling of modes between nonadjacent resonators by means of slotted diaphragms.

SUMMARY OF THE INVENTION

Accordingly, in accordance with the present invention a planar filter is proposed, which has a substrate, a plurality of striplines arranged next to one another on the substrate, and an overcoupling stripline which couples to one another two of the striplines which are not immediately neighboring, the overcoupling stripline having a length which is an integral multiple of a half wave-length of a center frequency of the filter.

The planar filter having these defining features has, by contrast, the advantage that the coupling of nonadjacent, that is to say not neighboring, striplines makes it possible to generate zero points in the transfer function H(s) and thus pole points in the stop band of the filter. Owing to these singularities in the damping, these filters have a relatively high edge steepness.

If the overcoupling stripline is likewise arranged on the substrate, there is a reduction in the cost of producing the planar filter.

The degree of overcoupling, and thus the effectiveness of the overcoupling, increases advantageously if the striplines are coupled at the lateral surfaces to the overcoupling stripline.

If the overcoupling stripline is guided so as to produce only a slight coupling between the overcoupling stripline and the stripline situated between the two striplines to be coupled, there is an improvement in the filter characteristic, since undesired overcouplings are reduced thereby.

If the overcoupling stripline is as short as possible, it is also only slightly affected by losses, as a result of which there is again likewise a rise in the degree of overcoupling.

Adapting the characteristic impedance of the overcoupling stripline reduces undesired reflections during coupling and thereby, in turn, increases the coupling efficiency.

DESCRIPTION OF THE PREFERRED EMBODIMENTS

Figure 1:
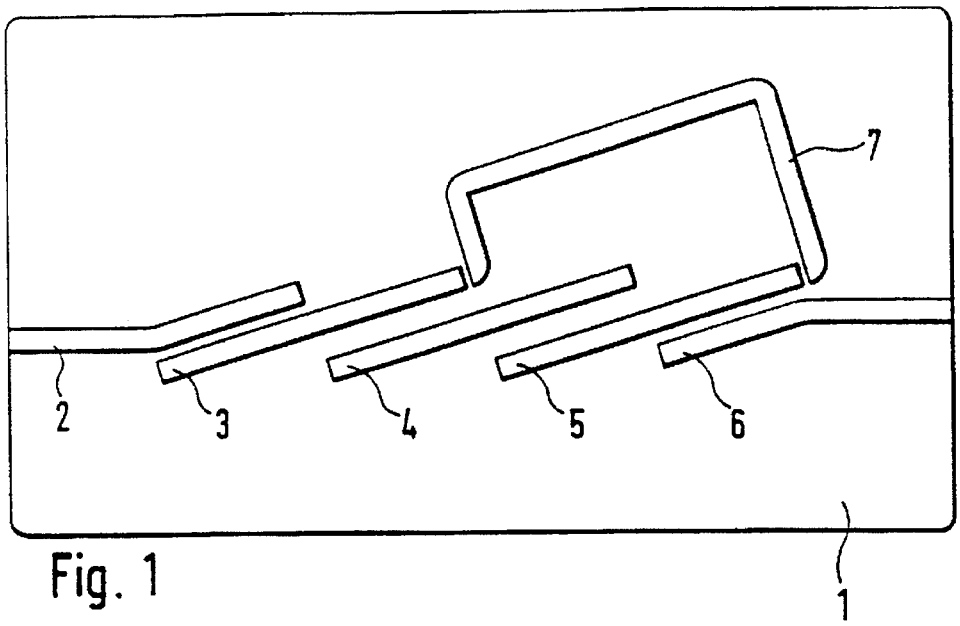
FIG. 1 shows a plan view of a first embodiment of a planar filter.

Illustrated in FIG. 1 is a substrate 1 having a flat surface and on whose top side a plurality of striplines 2, 3, 4, 5, 6 are arranged. In this case, one stripline 2 forms the input stripline and, in turn, one stripline 6 forms the output stripline. Arranged between the input stripline 2 and the output stripline 6 are the left-hand stripline 3, the middle stripline 4 and the right-hand stripline 5. The striplines all have an elongated, approximately rectangular shape and overlap one another in their transverse projection on a portion of their length in each case. In the region of these overlaps, the striplines 2, 3, 4, 5, 6 are respectively separated from one another in pairs only by a slight gap, thereby resulting in a coupling of the striplines 2, 3, 4, 5, 6 overlapping one another in this region. Furthermore, an overcoupling stripline 7 is provided which is coupled at the end face of the left-hand stripline 3 and is separated therefrom by a gap, and which connects this end face of the left-hand stripline 3 to the end face of the right-hand stripline 5, there likewise being a gap present between the overcoupling stripline 7 and the right-hand stripline 5.

This arrangement forms a planar filter for filtering radio-frequency electromagnetic waves. The passing and blocking characteristics of the planar filter are fixed by the geometry of the planar filter and by the material properties of the striplines 2, 3, 4, 5, 6 and of the substrate 1. This can be expressed by the transfer function H(s). Striplines 3, 5 which are not situated adjacent to one another and without the overcoupling stripline 7 are coupled to one another only indirectly via the middle stripline 4, are coupled by the overcoupling stripline 7. Because of the coupling of the left-hand stripline 3 to the right-hand stripline 5, zero points are produced in the transfer function H(s) which appear as damping poles in the blocking zone of the planar filter. Owing to this presence of singularities in the damping range, a substantially higher edge steepness can be produced in this planar filter than in known planar, laterally coupled filters.

It is advantageous if the overcoupling stripline 7 has the same, normalized width as the input stripline 2 and the output stripline 6. As a result, these three striplines 2, 6, 7 have a normalized characteristic impedance $Z_0$, which is usually 50 Ω. It is advantageous, furthermore, to select the length of the overcoupling stripline 7 as an integral multiple of the half wave-length λ of the center frequency of the filter, in order to effect optimum coupling to the striplines 3, 5 which are to be coupled to one another.

Figure 2:
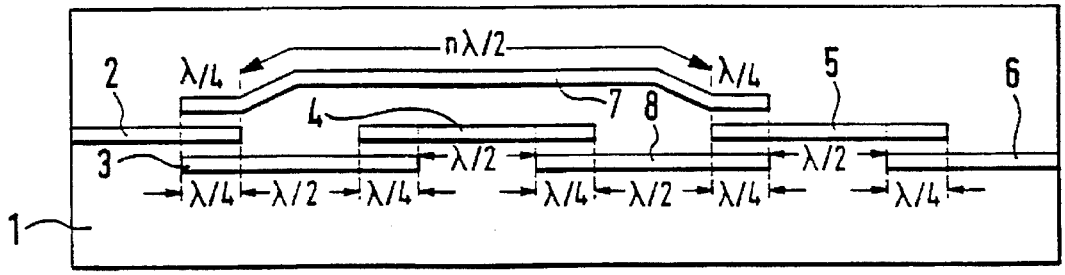
FIG. 2 shows a plan view of a second embodiment of a planar filter.

FIG. 2 shows a further exemplary embodiment of a planar filter, the numbering of the elements having been taken over from FIG. 1. The filter shown has an additional stripline 8, which is arranged with respect to the coupling sequence between the middle stripline 4 and the right-hand stripline 5. In addition, in this figure a dimensioning rule for the planar bandpass filter represented here is shown by way of example and can also be applied to other filters. All the striplines 2, 3, 4, 5, 6, 8 have an electric length of λ in this case, λ being the wavelength at the center frequency of the bandpass filter. The striplines 2, 3, 4, 5, 6, 8 overlap one another in this arrangement in each case by a length of λ/4. The overcoupling stripline 7 is arranged here for the purpose of coupling the input stripline 2 to the right-hand stripline 5. In this exemplary embodiment, the overcoupling stripline 7 is coupled to the two striplines 2, 5 not via their end faces but also via their lateral surfaces. Here, as well, the length of the overcoupling zones is λ/4 in each case. The entire overcoupling stripline 7 has a length, in general terms, of $l=(n+1)\lambda/2$, n being a natural number.

The planar filters represented in the two exemplary embodiments have overcoupling striplines 7 which, like the other striplines 2, 3, 4, 5, 6, 8, are arranged directly on the substrate 1. However, it is also possible to implement embodiments in which the overcoupling stripline 7 is arranged in a different plane from the striplines 2, 3, 4, 5, 6, 8. This is explained in more detail here with the aid of FIG. 1. Thus, it is likewise possible in the example represented there to cover the middle stripline 4 with an insulating layer, and to guide the overcoupling stripline 7 over said insulating layer. The length of the overcoupling stripline 7 can thereby be kept particularly short.

It ought to be borne in mind, in particular, that the overcoupling stripline 7 is short and, furthermore, has a spacing from the stripline 4, situated between the two striplines 3, 5 which are to be coupled to one another, which effects the smallest possible coupling to this stripline 4. The lower the degree of this disturbing coupling, the lower the losses of the filter and the more precisely it functions. Furthermore, the overcoupling stripline 7 should be adapted to the characteristic impedance $Z_O$, in order to avoid reflections. This adaptation is most readily achieved if the overcoupling stripline 7 has a constant width $W(Z_O)$. By contrast, the striplines 3, 4, 5 need not necessarily have a uniform characteristic impedance, and can therefore also vary in their width.

Figure 3:
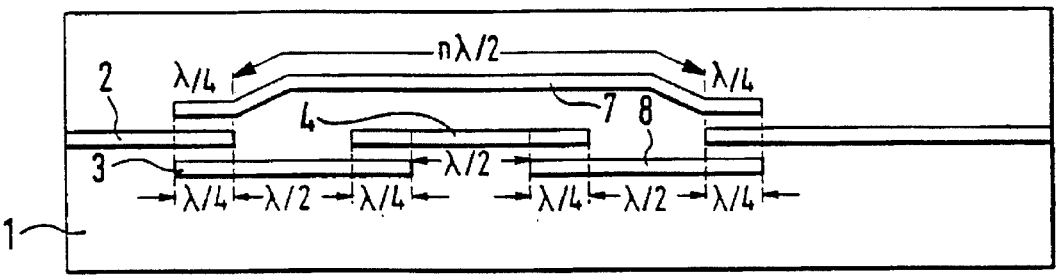
FIG. 3 shows a further embodiment of a planar filter with a coupling of input and output striplines.

FIG. 3 shows a further embodiment of the planar filter in accordance with the present invention. In this embodiment the two striplines are again coupled with one another. In particular the input stripline 2 is coupled with the output stripline 6.

We claim:

1. A planar filter, comprising a substrate; a plurality of striplines arranged next to one another on said substrate; and an overcoupling stripline which couples to one another two of said striplines which are not immediately neighboring, said overcoupling stripline having a length which is an integral multiple of a half wave-length of a center frequency of the filter.

2. A planar filter as defined in claim 1, wherein said overcoupling stripline is also arranged on said substrate.

3. A planar filter as defined in claim 1, wherein said two striplines have lateral surfaces, said overcoupling stripline being coupled via a gap to said two striplines at said lateral surfaces.

4. A planar filter as defined in claim 1, wherein said striplines include at least one third stripline located between said two striplines, said overcoupling stripline being at a spacing from said at least one third stripline so as to produce a slight coupling between said overcoupling stripline and said at least one third stripline.

5. A planar filter as defined in claim 1, wherein said overcoupling stripline extends over a short as possible distance between said two striplines which are not immediately neighboring.

6. A planar filter as defined in claim 1, wherein said overcoupling stripline has a constant width.

7. A planar filter as defined in claim 1, wherein one of said two striplines which are coupled to one another by said overcoupling stripline is an input stripline, while the other of said two striplines which are coupled to one another by said overcoupling stripline is an output stripline, said overcoupling stripline, said input stripline and said output stripline having approximately equal characteristic impedances.

* * * * *